US009076289B2

(12) United States Patent
Radek et al.

(10) Patent No.: US 9,076,289 B2
(45) Date of Patent: Jul. 7, 2015

(54) CONTROLLING AUDIO IN A WAGERING GAME SYSTEM

(71) Applicant: WMS Gaming, Inc., Waukegan, IL (US)

(72) Inventors: Paul J. Radek, Naperville, IL (US); Edward G. Brunell, Chiago, IL (US)

(73) Assignee: WMS Gaming, Inc., Waukegan, IL (US)

( * ) Notice: Subject to any disclaimer, the term of this patent is extended or adjusted under 35 U.S.C. 154(b) by 204 days.

(21) Appl. No.: 13/713,008

(22) Filed: Dec. 13, 2012

(65) Prior Publication Data

US 2013/0150163 A1 Jun. 13, 2013

Related U.S. Application Data

(60) Provisional application No. 61/570,032, filed on Dec. 13, 2011.

(51) Int. Cl.
*G07F 17/32* (2006.01)
*G07F 17/34* (2006.01)

(52) U.S. Cl.
CPC ..... *G07F 17/3225* (2013.01); *G07F 17/3234* (2013.01)

(58) Field of Classification Search
CPC ... G07F 17/34; G07F 17/3211; G07F 17/323; A63F 13/10; A63F 2300/64; A63F 2300/6063
USPC ..... 463/35, 31, 25, 42, 30
See application file for complete search history.

(56) References Cited

U.S. PATENT DOCUMENTS

| | | | | |
|---|---|---|---|---|
| 6,645,067 | B1 | 11/2003 | Okita et al. | |
| 8,184,824 | B2 | 5/2012 | Hettinger et al. | |
| 2007/0036368 | A1 | 2/2007 | Hettinger et al. | |
| 2008/0113715 | A1 | 5/2008 | Beadell et al. | |
| 2008/0113716 | A1 | 5/2008 | Beadell et al. | |
| 2008/0113796 | A1 | 5/2008 | Beadell et al. | |
| 2011/0223993 | A1* | 9/2011 | Allen et al. | 463/30 |
| 2011/0300925 | A1* | 12/2011 | Adiraju et al. | 463/25 |
| 2012/0178523 | A1* | 7/2012 | Greenberg et al. | 463/25 |

FOREIGN PATENT DOCUMENTS

| | | |
|---|---|---|
| WO | WO-2008057588 | 5/2008 |
| WO | WO-2008066686 | 6/2008 |
| WO | WO-2009009269 | 1/2009 |

* cited by examiner

*Primary Examiner* — Pierre E Elisca
(74) *Attorney, Agent, or Firm* — DeLizio Law, PLLC

(57) ABSTRACT

A wagering game system and its operations are described herein. In some embodiments, the operations include analyzing sound content that is not configured for use with a wagering game machine's sound system prior to presentation via sound equipment of the wagering game machine. If the sound content meets sound presentation tolerances of the sound equipment, then the operations can include approving presentation of the sound content. If a portion of the sound content does not meet the sound presentation tolerances, the operations can further include removing or modifying the portion of the sound content, such as filtering frequencies, reducing power levels, reducing volume levels, and reducing a duration of play of the sound content. The operations can further include prioritizing presentation of the sound content along with other content configured for use with the wagering game machine's sound system and which is scheduled for presentation via the sound equipment.

28 Claims, 9 Drawing Sheets

| QUEUED CONTENT | PRESENTATION PRIORITY | TIME SHIFT? | MODIFY? | HOW MODIFIED |
|---|---|---|---|---|
| CELEBRATORY SOUND | 1ST | | | |
| SECURITY ANNOUNCEMENT | 2ND | Y | Y | PRESENT AS TEXT |
| GROUP GAME SOUND 1 | 3RD | N | N | |

| | QUEUED CONTENT | PRESENTATION PRIORITY | TIME SHIFT? | MODIFY? | HOW MODIFIED |
|---|---|---|---|---|---|
| 511 | SECURITY ANNOUNCEMENT | 1ST | | | |
| 513 | GROUP GAME SOUND 2 | 2ND | N | Y | REDUCE VOLUME |
| 515 | MARKETING ANNOUNCEMENT | 3RD | N | Y | PRESENT AS TEXT |
| 517 | BACKGROUND MUSIC | 4TH | N | N | |

CONTROLLING AUDIO IN A WAGERING GAME SYSTEM

RELATED APPLICATIONS

This application claims the priority benefit of U.S. Provisional Application Ser. No. 61/570,032 filed Dec. 13, 2011.

LIMITED COPYRIGHT WAIVER

A portion of the disclosure of this patent document contains material that is subject to copyright protection. The copyright owner has no objection to the facsimile reproduction by anyone of the patent disclosure, as it appears in the Patent and Trademark Office patent files or records, but otherwise reserves all copyright rights whatsoever. Copyright 2012, WMS Gaming, Inc.

TECHNICAL FIELD

Embodiments of the inventive subject matter relate generally to wagering game systems and networks that, more particularly, control wagering game system audio.

BACKGROUND

Wagering game machines, such as slot machines, video poker machines and the like, have been a cornerstone of the gaming industry for several years. Generally, the popularity of such machines depends on the likelihood (or perceived likelihood) of winning money at the machine and the intrinsic entertainment value of the machine relative to other available gaming options. Where the available gaming options include a number of competing wagering game machines and the expectation of winning at each machine is roughly the same (or believed to be the same), players are likely to be attracted to the most entertaining and exciting machines. Shrewd operators consequently strive to employ the most entertaining and exciting machines, features, and enhancements available because such machines attract frequent play and hence increase profitability to the operator. Therefore, there is a continuing need for wagering game machine manufacturers to continuously develop new games and gaming enhancements that will attract frequent play.

To enhance a player's wagering game experience, some wagering game manufacturers create wagering game systems with advanced and expensive sound systems. The sound systems are specifically configured for specific sound levels and sound files. Any attempts to feed non-configured, external audio feeds into the wagering game machine's sound system, such as by casino operators, player devices, etc., can cause the wagering game machine's audio system to generate sounds that the system was not designed to handle. For example, sounds driven by external op-amps can add an excess of power to delicate sound equipment. Further, non-configured sounds can play with excessive amounts of unbalanced attributes (e.g., excessive bass frequencies) or for excessive periods, which can draw excessive current from a wagering game machine's power supply. As a result, the external audio feeds can cause damage to the expensive sound systems or to other components of a wagering game machine.

BRIEF DESCRIPTION OF THE DRAWING(S)

Embodiments are illustrated in the Figures of the accompanying drawings in which.

DESCRIPTION OF ILLUSTRATIVE EMBODIMENTS

This description of the embodiments is divided into six sections. The first section provides an introduction to embodiments. The second section describes example operating environments while the third section describes example operations performed by some embodiments. The fourth section describes additional example embodiments while the fifth section describes additional example operating environments. The sixth section presents some general comments.

Introduction

This section provides an introduction to some embodiments.

Many computerized wagering game systems have a variety of sound and graphical elements designed to attract and keep a game player's attention, such as sound effects, music, and animation. These game presentation features often include a variety of music, sound effects, and voices presented to complement a visual (e.g., video, computer animated, mechanical, etc.) presentation of the wagering game on a display. Those sounds have been specifically configured to play at certain volume levels, for certain durations, and with a right amount of frequencies that will not damage expensive sound equipment that is included in a wagering game system. However, as mentioned previously, sometimes sounds that are not configured for specific use with the expensive sound equipment ("non-configured sounds") may be fed to a wagering game machine's sound equipment and could potentially damage the sound equipment. One example of non-configured sounds include sound content that has not been previously tested on, and/or optimized for use with, the sound equipment, such as sound content that has not been specifically created for use in a wagering game application via the wagering game machine. Such sound content may originate from unauthorized, external sources that are connected to the wagering game machine after the wagering game machine has been delivered to an operator (e.g., a casino).

Some embodiments of the present subject matter describe examples of controlling wagering game system audio on a wagering game machine or other computerized wagering game system, to analyze or evaluate audio characteristics of the non-configured sounds before they are played by the wagering game machine's sound equipment. Based on analysis of the audio characteristics, some embodiments describe excluding all or portions of the non-configured sounds. Some embodiments include reconfiguring the sounds, such as by modifying one or more of the audio characteristics (e.g., filtering potentially damaging frequencies, decreasing a volume level, reducing a power level, converting the sounds to a textual presentation, changing locations for presentation of sounds, etc.). Some embodiments further comprise prioritizing the presentation of non-configured, or re-configured, sounds, that comes from external sources with sounds that originate from wagering games presented via the wagering game machine.

Figure 1:
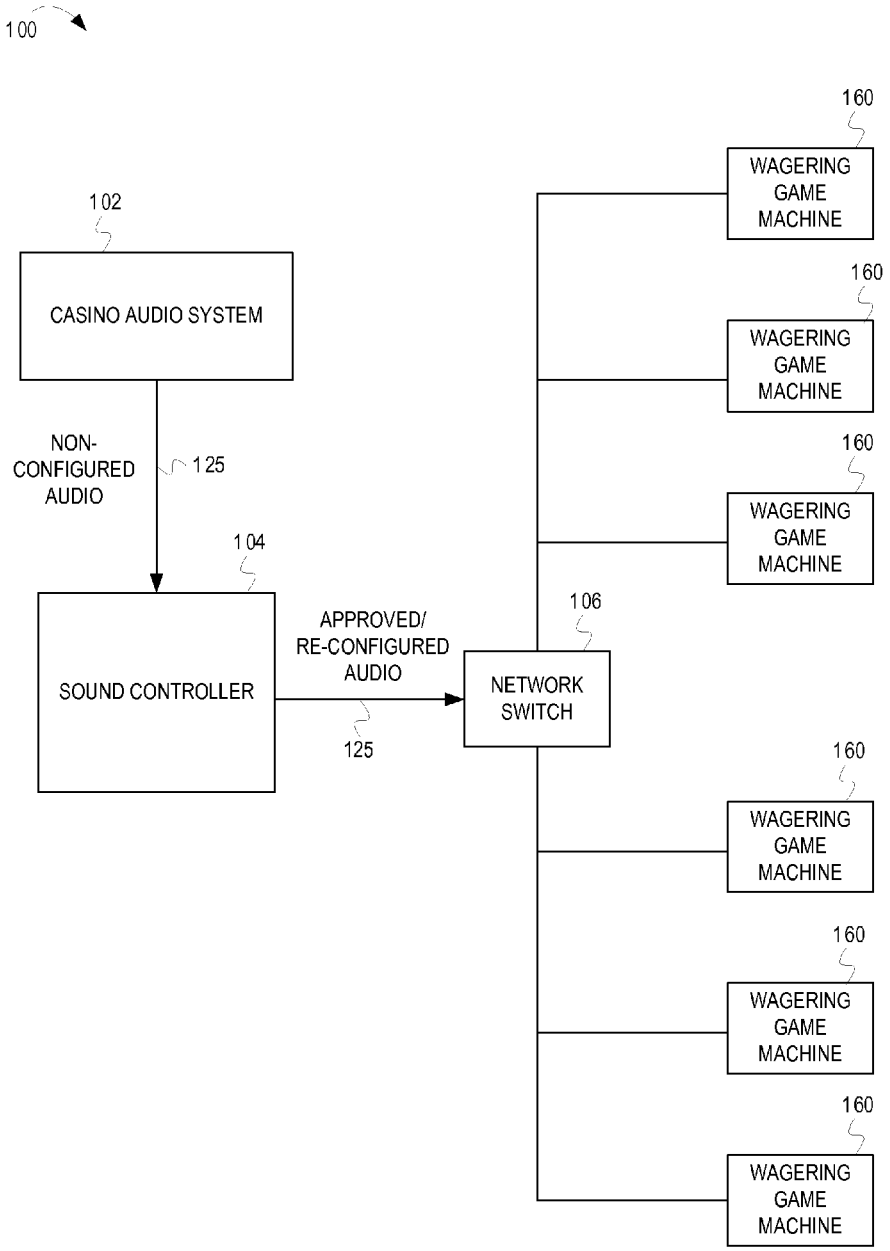
FIG. 1 is an example block diagram of a gaming sound control system configured to control presentation of non-configured audio feeds from sources external to a wagering game machine, according to some embodiments.

FIG. 1 is an example block diagram of a gaming sound control system configured to control presentation of non-configured audio feeds from sources external to a wagering game machine, according to some embodiments. In FIG. 1, a gaming sound control system ("system") 100 includes a sound controller 104 connected to a casino audio system 102. The sound controller 104 is also connected to a plurality of wagering game machines 160 via a network switch 106. The sound controller 104 can receive an audio feed 125 of non-configures sounds (also referred to as "non-configured audio") from the casino audio system 102 and evaluate one or more characteristics of the audio feed 125, as well as characteristics of other sounds presented contemporaneously at any one of the wagering game machines 160, and determine how, when, or whether to present the audio feed 125. The sound controller 104 can approve the presentation of the sounds in the audio feed 125 and/or reconfigure the sounds (e.g., modify the sounds) so that they can be presented on any of the wagering game machines 160 without damaging sound equipment, or other components, of the wagering game machines 160. For example, the sound controller 104 can check frequencies of sounds in the audio feed 125 that would potentially damage sound equipment associated with any of the wagering game machines 160 (e.g., check for frequencies that are too high or too low) and filter those frequencies. In some embodiments, the sound controller 104 can also check other characteristics that could damage sound equipment, such as a duration of sounds in the audio feed 125, power levels of sounds in the audio feed 125, a number of sounds presented at any of the wagering game machines 160, etc. The sound controller 104 can also evaluate characteristics of the sound equipment such as design specifications, tolerance values, etc. The sound controller 104 can also evaluate other sounds, such as gaming sounds presented via applications presented via any of the wagering game machines 160, which other sounds are played, or scheduled to be played in the future, at the sound equipment. When sounds from the audio feed 125 are played concurrently with other sounds, the combined sounds, power levels, etc. may create excessive power loads, frequencies, etc., that can damage the sound equipment and/or that can sound distorted. The sound controller 104 can filter frequencies of sounds from the audio feed 125 (e.g., filter out lower frequencies that can draw too much power, such as frequencies that are below approximately 200 hertz (Hz), filter out higher frequencies that are potentially annoying to patrons, such as frequencies above 5 kilo-hertz (KHz), or a combination of low frequencies and high frequencies). The sound controller 104 can further filter out frequencies that may interfere with other gaming content configured with higher frequencies. For example, the sound controller 104 can filter out frequencies of announcements that may interfere with other control signals used in other subsystems or modules of a wagering game system, such control frequencies above 44 KHz used in a three-dimensional (3D) specialization system. In addition to, or instead of, filtering out values, the sound controller 104 can modify characteristics of sounds within certain frequencies, such as to key down high frequencies or increase lower frequencies. In some embodiments, the sound controller 104 can resample a data rate of a sound received from an audio feed 125 and filter at frequency proportional to the modified data rate. In some embodiments, the system can also normalize sounds (e.g., combined sounds) to be at appropriate sound levels.

The sound controller 104 can further manage how, when, and if the audio is presented to the user. For example, the sound controller 104 can evaluate a significance of a sound content from the audio feed 125 against a significance of a gaming sound content for an application being played at any of the wagering game machines 160 or scheduled for future presentation in a way that would overlap with the presentation of the sound content from the audio feed 125. Based on the evaluation, the sound controller 104 prioritizes the presentation of the sound content from the audio feed 125 and/or the gaming sound content according to order or presentation, volume levels, location of presentation, and so forth. The sound controller 104 can further modify sounds from a default state, such as filtering frequencies of sounds, modifying volumes of sounds, changing locations for presentation of sounds, etc., based on the evaluation of characteristics of sounds.

In FIG. 1, the sound controller 104 is incorporated with a central controller on a network. The central controller evaluates sound characteristics and sends instructions to any of the wagering game machines 160 to interpret for presentation of the audio feed 125. In some embodiments, the sound controller 104 includes separate modules or units that are positioned in difference places in a network, such in the central controller, in a wagering game server, and/or in any of the wagering game machines 160. In other embodiments, the sound controller 104 can be associated with any of the wagering game machines 160. In some embodiments, a sound controller on any of the wagering game machines 160 can communicate with a sound controller on a central server, and the two modules can negotiate when, how, and whether to play announcements, gaming sounds, etc.

Figure 2:
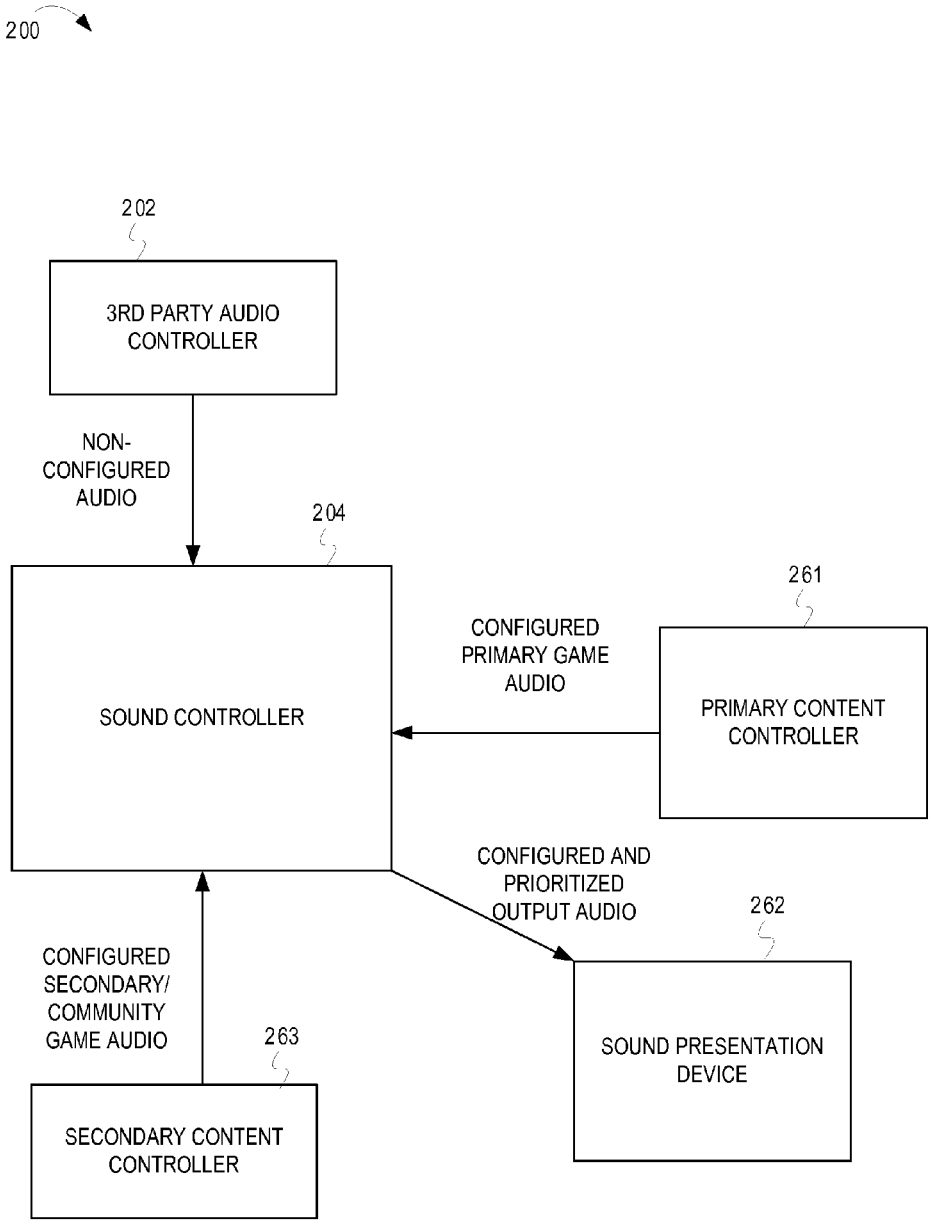
FIG. 2 is an example block diagram of a gaming sound control system configured to control presentation of non-configured audio feeds from sources external to a wagering game machine, according to some embodiments.

FIG. 2 is an example block diagram of a gaming sound control system configured to control presentation of non-configured audio feeds from sources external to a wagering game machine, according to some embodiments. In FIG. 2, a wagering game system ("system") 200 includes a sound controller 204 connected to a third party audio controller 202. The sound controller 104 is also connected to a primary content controller 261, a secondary content controller 263 and a sound presentation device 262. In FIG. 2, the sound controller is not depicted as being contained within any particular component on a wagering game network, and could be incorporated into one, or more, components, such as a central controller, a wagering game machine, etc. The third party audio controller 202 is any source of sounds that are not pre-configured for use with sound equipment on a wagering game machine, such as a casino audio system, a player device, a video controller, a marketing server, etc. The primary content controller 261 provides primary wagering game content from a primary wagering game application (e.g., from a base game). The secondary content controller 263 provides secondary wagering game content from a secondary wagering game application, such as from server-based games, community wagering games, etc. The primary content and secondary content are pre-configured for use on a wagering game machine. The sound controller 204 analyzes audio characteristics of the audio that has not been pre-configured as well as audio that has been pre-configured, and can approve, modify, prioritize, or otherwise control the presentation of all audio content to be presented in a wagering game session via sound equipment of a wagering game machine.

In some embodiments, audio may be transmitted via one or more types of networked wagering venues (e.g., a casino, an online casino, a wagering game website, a wagering network, etc.). Embodiments can be presented over any type of communications network (e.g., public or private) that provides access to wagering games, such as a website (e.g., via wide-area-networks, or WANs), a private gaming network (e.g., local-area-networks, or LANs), a file sharing networks, a social network, etc., or any combination of networks. Multiple users can be connected to the networks via computing devices. The multiple users can have accounts that subscribe to specific services, such as account-based wagering systems (e.g., account-based wagering game websites, account-based casino networks, etc.). In some embodiments herein a user may be referred to as a player (i.e., of wagering games), and a player may be referred to interchangeably as a player account. Account-based wagering systems utilize player accounts when transacting and performing activities, at the computer level, that are initiated by players. Therefore, a "player account" represents the player at a computerized level. The player account can perform actions via computerized instructions. For example, in some embodiments, a player account may be referred to as performing an action, controlling an item, communicating information, etc. Although a player, or person, may be activating a game control or device to perform the action, control the item, communicate the information, etc., the player account, at the computer level, can be associated with the player, and therefore any actions associated with the player can also be associated with the player account. Therefore, for brevity, to avoid having to describe the interconnection between player and player account in every instance, a "player account" may be referred to herein in either context. Further, in some embodiments herein, the word "gaming" is used interchangeably with "gambling".

Although FIGS. 1 and 2 describe some embodiments, the following sections describe many other features and embodiments.

Example Operating Environments

This section describes example operating environments and networks and presents structural aspects of some embodiments. More specifically, this section includes discussion about wagering game system architectures.

Wagering Game System Architecture

Figure 3:
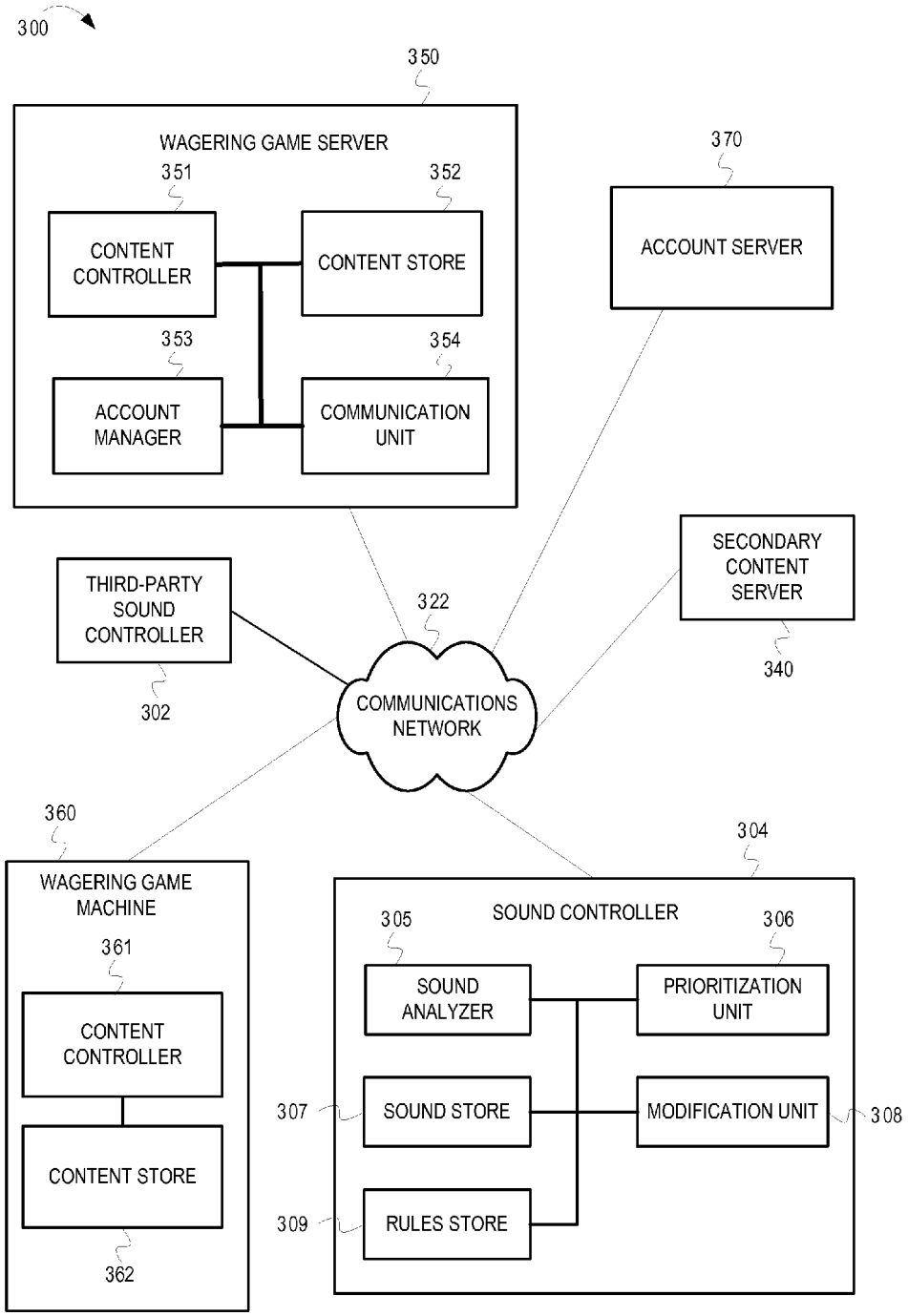
FIG. 3 is an illustration of a wagering game system architecture 300, according to some embodiments.

FIG. 3 is an illustration of a wagering game system architecture 300, according to some embodiments. The wagering game system architecture 300 can include an account server 370 configured to control user related accounts accessible via wagering game networks and social networks. The account server 370 can store and track player information, such as identifying information (e.g., avatars, screen name, account identification numbers, etc.) or other information like financial account information, social contact information, etc. The account server 370 can contain accounts for social contacts referenced by the player account. The account server 370 can also provide auditing capabilities, according to regulatory rules, and track the performance of players, machines, and servers.

The wagering game system architecture 300 can also include a wagering game server 350 configured to control wagering game content, provide random numbers, and communicate wagering game information, account information, and other information to and from a wagering game machine 360. The wagering game server 350 can include a content controller 351 configured to manage and control content for the presentation of content on the wagering game machine 360. For example, the content controller 351 can generate game results (e.g., win/loss values), including win amounts, for games played on the wagering game machine 360. The content controller 351 can communicate the game results to the wagering game machine 360. The content controller 351 can also generate random numbers and provide them to the wagering game machine 360 so that the wagering game machine 360 can generate game results. The wagering game server 350 can also include a content store 352 configured to contain content to present on the wagering game machine 360. The wagering game server 350 can also include an account manager 353 configured to control information related to player accounts. For example, the account manager 353 can communicate wager amounts, game results amounts (e.g., win amounts), bonus game amounts, etc., to the account server 370. The wagering game server 350 can also include a communication unit 354 configured to communicate information to the wagering game machine 360 and to communicate with other systems, devices and networks.

The wagering game system architecture 300 can also include the wagering game machine 360 configured to control and present wagering games. The wagering game machine 360 can include a content controller 361 configured to manage and control content and presentation of content on the wagering game machine 360. The wagering game machine 360 can also include a content store 362 configured to contain content to present on the wagering game machine 360.

The wagering game system architecture 300 can also include a secondary content server 340 configured to provide content and control information for secondary games and other secondary content available on a wagering game network (e.g., secondary wagering game content, promotions content, advertising content, player tracking content, web content, etc.). The secondary content server 340 can provide "secondary" content, or content for "secondary" games presented on the wagering game machine 360. "Secondary" in some embodiments can refer to an application's importance or priority of the data. In some embodiments, "secondary" can refer to a distinction, or separation, from a primary application (e.g., separate application files, separate content, separate states, separate functions, separate processes, separate programming sources, separate processor threads, separate data, separate control, separate domains, etc.). Nevertheless, in some embodiments, secondary content and control can be passed between applications (e.g., via application protocol interfaces), thus becoming, or falling under the control of, primary content or primary applications, and vice versa.

The wagering game system architecture 300 can also include a sound controller 304 configured to control sounds from multiple sources, such as from the wagering game machine 360, the wagering game server 350, the secondary content server 340, and a third party sound controller 302. The sound controller 304 includes a sound analyzer 305 to analyze/evaluate sounds that originate from the multiple sources. For instance, the sound analyzer 305 analyzes sounds from the third party sound controller 302 that were not configured for use with sound equipment associated with the wagering game machine 360. The sound analyzer 305, for example, can evaluate metadata of sounds that indicate sound types, power levels, frequencies, significance values, etc. The sound controller 304 also includes a prioritization unit 306 configured to determine a priority of presentation for non-configured sounds from the third party sound controller 302 and configured sounds that come from the content stores 352 and 362 and that are associated with wagering game applications. The sound controller 304 also includes a sound store 307 to store one or more of non-configured sounds and configured sounds to analyze the sounds, to delay or time-shift the presentation of the sounds, to capture and integrate sounds, to reuse sounds, etc. The sound controller 304 also includes a modification unit 308 to modify sounds (e.g., edit, filter, normalize, convert, etc.). For example, the modification unit 308 filters specific frequencies that can damage sound equipment or other components of the wagering game machine 360. The modification unit 308 can add leader tones, trailer tones, priority values, theme types, classifications, durations, or other metadata that indicates information about the sounds. The sound controller 304 also includes a rules store 309 that stores rules regarding sound analysis, prioritization, and/or modification.

Each component shown in the wagering game system architecture 300 is shown as a separate and distinct element connected via a communications network 322. However, some functions performed by one component could be performed by other components. For example, the wagering game server 350 or the wagering game machine 360 can also be configured to perform functions of the sound controller 304, and other network elements and/or system devices. Furthermore, the components shown may all be contained in one device, but some, or all, may be included in, or performed by multiple devices, as in the configurations shown in FIG. 3 or other configurations not shown. For example, the account manager 353 and the communication unit 354 can be included in the wagering game machine 360 instead of, or in addition to, being a part of the wagering game server 350. Further, in some embodiments, the wagering game machine 360 can determine wagering game outcomes, generate random numbers, etc. instead of, or in addition to, the wagering game server 350.

The wagering game machines described herein (e.g., the wagering game machine 360) can take any suitable form, such as floor standing models, handheld mobile units, bar-top models, workstation-type console models, surface computing machines, etc. Further, wagering game machines can be primarily dedicated for use in conducting wagering games, or can include non-dedicated devices, such as smart phones, personal digital assistants, personal computing devices, etc.

In some embodiments, wagering game machines and wagering game servers work together such that wagering game machines can be operated as thin, thick, or intermediate clients. For example, one or more elements of game play may be controlled by the wagering game machines (client) or the wagering game servers (server). Game play elements can include executable game code, lookup tables, configuration files, game outcome, audio or visual representations of the game, game assets or the like. In a thin-client example, the wagering game server can perform functions such as determining game outcome or managing assets, while the wagering game machines can present a graphical representation of such outcome or asset modification to the user (e.g., player). In a thick-client example, the wagering game machines can determine game outcomes and communicate the outcomes to the wagering game server for recording or managing a player's account.

In some embodiments, either the wagering game machines (client) or the wagering game server(s) can provide functionality that is not directly related to game play. For example, account transactions and account rules may be managed centrally (e.g., by the wagering game server(s)) or locally (e.g., by the wagering game machines). Other functionality not directly related to game play may include power management, presentation of advertising, software or firmware updates, system quality or security checks, etc.

Furthermore, the wagering game system architecture 300 can be implemented as software, hardware, any combination thereof, or other forms of embodiments not listed. For example, any of the network components (e.g., the wagering game machines, servers, etc.) can include hardware and machine-readable storage media including instructions for performing the operations described herein.

Example Operations

This section describes operations associated with some embodiments. In the discussion below, some flow diagrams are described with reference to block diagrams presented herein. However, in some embodiments, the operations can be performed by logic not described in the block diagrams.

In certain embodiments, the operations can be performed by executing instructions residing on machine-readable storage media (e.g., software), while in other embodiments, the operations can be performed by hardware and/or other logic (e.g., firmware). In some embodiments, the operations can be performed in series, while in other embodiments, one or more of the operations can be performed in parallel. Moreover, some embodiments can perform more or less than all the operations shown in any flow diagram.

Figure 4:
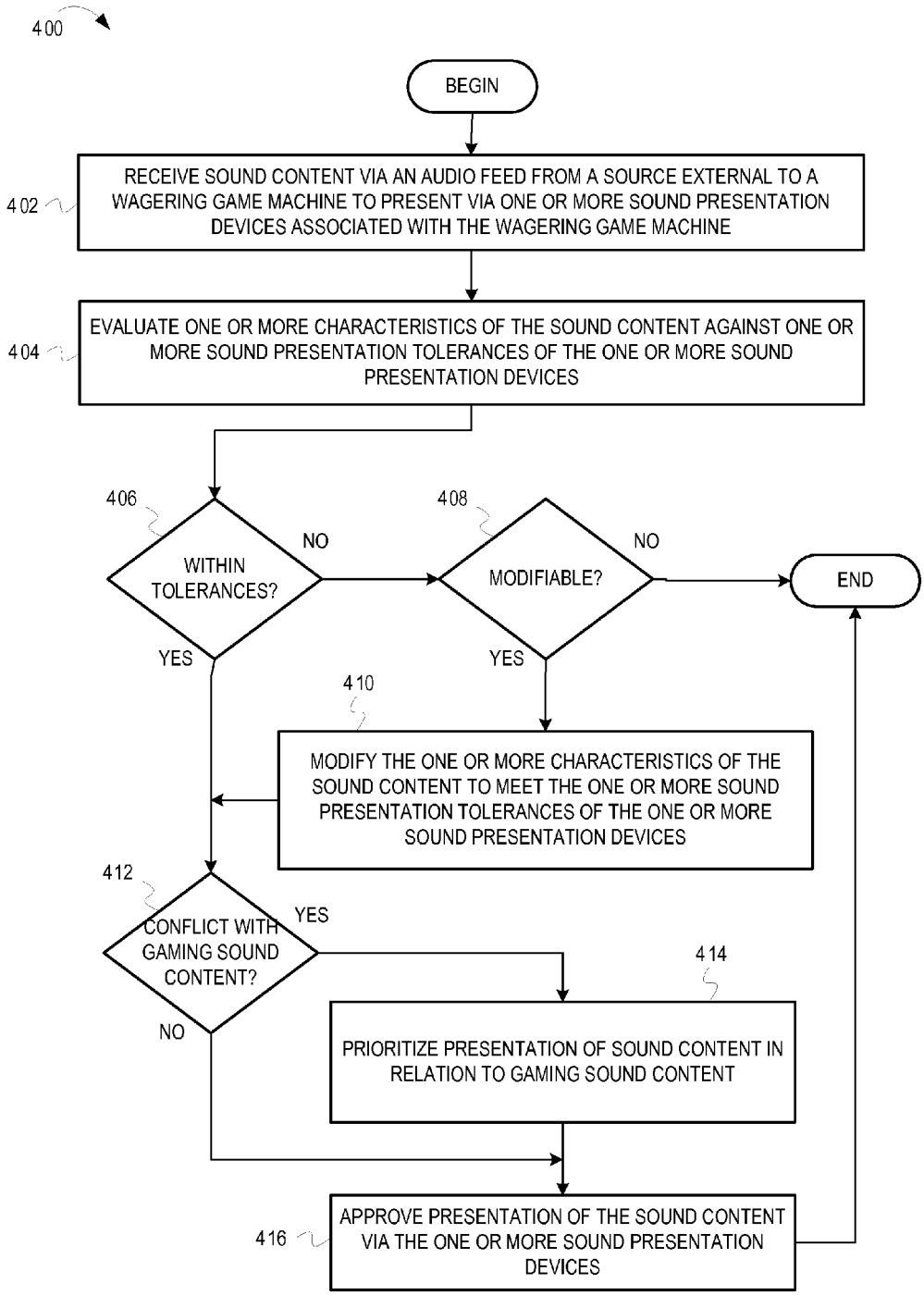
FIG. 4 is a flow diagram 400 illustrating controlling presentation of one or more portions of non-configured audio via sound presentation devices associated with a wagering game machine, according to some embodiments.

FIG. 4 is a flow diagram ("flow") 400 illustrating controlling presentation of one or more portions of non-configured audio from sound presentation devices associated with a wagering game machine, according to some embodiments. In FIG. 4, the flow 400 begins at processing block 402, where a gaming sound control system ("system") receives sound content via an audio feed from a source external to a wagering game machine to present via one or more sound presentation devices associated with the wagering game machine. As described previously, the source that is external to the wagering game machine can be a central controller, a third-party sound controller, a personal computing device attached to a wagering game machine, or any other source that provides sound content that has not been pre-configured for use with sound equipment associated with the wagering game machine. The sound content of the audio feed can include metadata that indicates significance values, types or classes of sounds, types of events associated with sounds, a description of an origin of the sounds, an amount of money won for an event associated with a sound, a description of a gaming accomplishment associated with a sound, a frequency value for the sound, a power level for the sound, a duration of a sound, a file marker for a sound file, a leader tone for a sound file, a trailer tone for a sound file, a file name of a sound file, a date associated with a sound, or any other value that describes, defines, or characterizes the sound content.

The flow continues at processing block 404 where the system evaluates one or more characteristics of the sound content against one or more sound presentation tolerances of the one or more sound presentation devices. The one or more characteristics may include characteristics that describe or define the sound content, such as power levels, frequencies, volume levels, durations, etc. In some embodiments, the system reads the one or more characteristics from metadata included in the sound content. In some embodiments, the system analyzes the sound content to ascertain the one or more characteristics. The sound presentation tolerances describe limits of use of the one or more sound presentation devices, such as power usage limits, frequency limits, volume limits, duration limits, and so forth. The system can refer to a storage that contains a listing of the sound presentation tolerances. In some embodiments, the sound presentation tolerances may vary based on sound content that is currently being played, or schedule to be played, at the one or more sound presentation devices. For example, a combination of one sound with another sound may exceed frequencies, power levels, etc., and, therefore, potentially exceed tolerances. Therefore, in some embodiments, the system further evaluates the one or more characteristics in combination with one or more other sound content that may be concurrently played with the sound content of the audio feed.

The flow continues at processing block 406 where the system determines, based on the evaluation of the at least a portion of the one or more characteristics against the one or more sound presentation tolerances whether the at least a portion of the one or more characteristics would exceed the one or more sound presentation tolerances. If the system determines, based on the evaluation of the one or more characteristics, that the one or more tolerances are not exceeded (i.e., that at least a portion of the sound content is presentable via the one or more sound presentation devices using the at least portion of the one or more characteristics), then the flow 400 continues at processing block 412. If, however, the system determines, based on the evaluation of the one or more characteristics, that the one or more characteristics exceed the one or more sound presentation tolerance, the flow continues at processing block 408 wherein the system determines whether the one or more characteristics can be modified. For example, if the characteristics can be modified so that at least a portion of the sound content is presentable via sound presentation devices, or if the sound content is predictable enough for potential presentation, then at processing block 410, the system modifies the one or more audio characteristics of the sound content to meet the one or more sound presentation tolerances of the one or more sound presentation devices. For example, the system may detect that the sound is a live audio feed without a discernible way of evaluating all potential characteristics of the sound content prior to presentation. A live audio feed is unpredictable as to what sound content will be presented. As a result, the system may determine that the audio characteristics of the sound content are unpredictable and, therefore, not potentially modifiable with a degree of certainty that would protect the integrity of the sound presentation devices. A sudden surge in power, for example, may potentially damage sound equipment. However, in some embodiments, the system can record the live audio feed and replay it with a slight delay so that the system can evaluate the audio characteristics of the recorded portion of the live audio feed before presenting it. In another embodiment, the system can set filters on sound frequencies above or below specific levels and set maximum volume levels as a precaution. Other sound content, however, may be fully evaluable from beginning to end, such as a sound file. The sound file may include metadata that describes the sound content, which the system can read and evaluate.

In some embodiments, the system can filter frequencies from the sound content as described in FIG. 1. The system utilizes various types of filters, such as a band-pass filter to remove specific high and low frequencies. Other known filter types can also be utilized.

In some embodiments, the system can embed tones in the sound content (e.g., add leader tones to the front of sound content and/or add trailer tones to the end of sound content). The embedded tones can indicate a beginning and/or end of sound content, identifiers for wager game machines, identifiers for groups of wagering game machines, sections of a casino, types of content, volume levels, or any other data regarding where the sound content should be played, how long the sound content should be played, how loud the sound content should be played, etc.

The flow continues at processing block 412 where the system determines whether presentation of the sound content would conflict with presentation gaming sound content, such as sounds from one or more wagering games played via a wagering game machine during a wagering game session. If the system determines that the sound content from the audio feed would not conflict with gaming sound content, the flow 400 continues as processing block 416 where the system approves presentation of at least a portion of the sound content of the audio feed that is within, or has been modified to be within, the one or more sound presentation tolerances. If the system determines that the presentation of the sound content would conflict with the presentation of gaming sound content, the flow 400 continues at processing block 414 where the system prioritizes presentation of the sound content in relation to the gaming sound content. Then, at processing block 416, the flow 400 continues where the system approves the presentation of the sound content from the audio feed according to a presentation priority in relation to the gaming sound content. Returning to the discussion of processing block 414, where the system prioritizes the presentation of the sound content from the audio feed in relation to the gaming sound content, in one example, the system decides to suppress the sound content from the audio feed and allow the gaming sound content to play without interruption. For instance, a general marketing announcement in the audio feed may have less significance than some game win events (e.g., a jackpot or large win). The system could include logic that decides to suppress a presentation of the general marketing announcement at that wagering game machine if it would overlap in presentation with a celebratory sound effect associated with the game win event, thus permitting the game win event to play the celebratory sound effect without interruption.

In another example, the system can decide to time shift presentation of either the sound content from the audio feed or the gaming sound content based on the evaluation. In some embodiments, the audio feed is provided as stream of live audio that has no delay instructions and, therefore, is configured for immediate presentation. However, the system can delay presentation of the sound content from the audio feed until after the gaming sound content is presented, or vice versa, depending on the evaluation. In other words, the system can generate a priority of presentation for the sound content (e.g., configured for immediate presentation) and the gaming sound content (e.g., which may be scheduled for presentation at the same time that the audio feed streams the sound content for immediate presentation). Using the priority, the system can present the sound content or the gaming sound content accordingly. For example, if the priority of the scheduled presentation of the gaming content is greater than the priority of the immediate presentation of the sound content, the system can generate a delay for the presentation of the sound content. For example, the system can buffer, or store portions of a sound stream from the audio feed, so that the system can time shift the sound content. In some embodiments, the system can detect when a wagering game machine enters an idle state of gaming play on a wagering game machine and, in response, present the sound content that has been time buffered from the audio feed.

In another example, the system suppresses the gaming sound content that has been scheduled for presentation and instead plays the sound content from the audio feed. For example, an emergency announcement within the audio feed may override presentation of any gaming sound content scheduled for presentation at the wagering game machine. Depending on the significance of the gaming sound content, the system may decide to either record and time shift/delay presentation of gaming sound content that was suppressed during presentation of the sound content from the audio feed, exclude presentation of the gaming sound content, modify the gaming sound content, present a portion of the gaming sound content, or some combination.

In another example, the system overlaps the presentation of the sound content from the audio feed with gaming sound content so that both play concurrently based on the evaluation. For example, both sounds may exceed a certain level of significance, but one has a relative significance more than another. Nevertheless, the system may determine that it is not practical or desirable to time shift presentation of one or the other. For instance, many game sounds may be played as part of a sound track, but at some times, such as when a game character speaks, the system can determine (e.g., based on rules and/or logic) that the sounds of the game character should be heard, while at the same time an important, external announcement via an audio feed needs to be played via the sound system. The system, therefore, may present both sounds concurrently, with higher volume on one or the other, depending on significance values or other factors. Other factors may include user preference, casino preference, relevance/significance of event types in a game (e.g., instructional events, game-critical events, etc.), capabilities of a game to present text instead of sounds, etc. The system can further analyze concurrently presented sounds and normalize the sounds to prevent damage to equipment and/or to improve sound quality of the combined sounds (e.g., filter out combined frequencies that may be annoying or too loud for a casino patron).

In some examples, if there is a conflict of presentation of sounds, the system determines whether to present one as a textual response instead of a sound. For example, if an announcement over the audio feed can be presented as text on a wagering game machine's display, and if the presentation of the announcement would conflict with an important gaming sound, the system may convert the announcement to text. The system then presents the text on the wagering game machine's display instead of attempting to overlap presentation of the sound content from the audio feed with gaming sound content via the same sound equipment. In another embodiment, instead of converting the sound content to a textual format, the system presents other content in a different visual format, such as a video file or a graphic. In some embodiments, the system provides an interface with a sound editor that a user can utilize to insert textual metadata tags into a sound file. Later, when the sound file is to be presented on the sound equipment of the wagering game machine, the system can read the sound file and present the metadata tags in addition to the sound content or instead of the sound content.

In another example, the system determines whether to shift presentation of sounds to other speakers nearby based on characteristics in the sound content from the audio feed and/or based on characteristics of gaming sound content. For example, the system may provide instructions in the audio feed to cause the gaming sound content to play on one of the speakers on wagering game machine, while sound content from the audio feed plays on another of the speakers of the wagering game machine, or nearby speakers on another wagering game machine, overhead speakers, etc. In another example, the system may include instructions to route the sound content from the audio feed to other nearby speakers.

In some embodiments, the system can send instructions to nearby wagering game machines to present the sound content from the audio feed and/or gaming sound content at louder volumes to compensate for being suppressed at a given wagering game machine. For example, if the system determines that a gaming sound is more significant than an announcement in the audio feed, the system may instead send the announcement to a neighboring wagering game machine and play it louder than normal (though not so loud as to damage the sound equipment) so that the announcement can be heard at the wagering game machine that suppressed the announcement. In another embodiment, the system can route gaming sound content to nearby wagering game machines and play the gaming sound content louder than would normally be played without being so loud as to damage sound equipment of the neighboring wagering game machines. For instance, a group of players may be playing a group game at neighboring wagering game machines, and the same sound track may be presented simultaneously at the group of wagering game machines during a group game event. If the system decides to present an announcement via a first one of the wagering game machines in the group, then the system determines to present the simultaneously presented sound track for the group game a few decibel levels higher on a second and/or third of the wagering game machines in the group that are adjacent to the first wagering game machine. Thus, a player at the first wagering game machine can more easily hear the soundtrack in the background while the announcement is being presented on the first wagering game machine. A similar effect could be accomplished by presenting the sound track simultaneously with the announcement at the first wagering game machine (e.g., on separate speakers) with separate volumes, if such is possible (e.g. if the first wagering game machine has multiple speakers, if playing multiple sounds on the same speakers would not damage sound/power equipment, etc.). For example, multiple sounds played from the same speakers could overload a power supply, so instead, the system may decide to shift the presentation of the sounds to other speakers either at the wagering game machine, or to nearby peripheral speakers, environmental speakers, or speakers at other wagering game machines in a bank.

Figure 5:
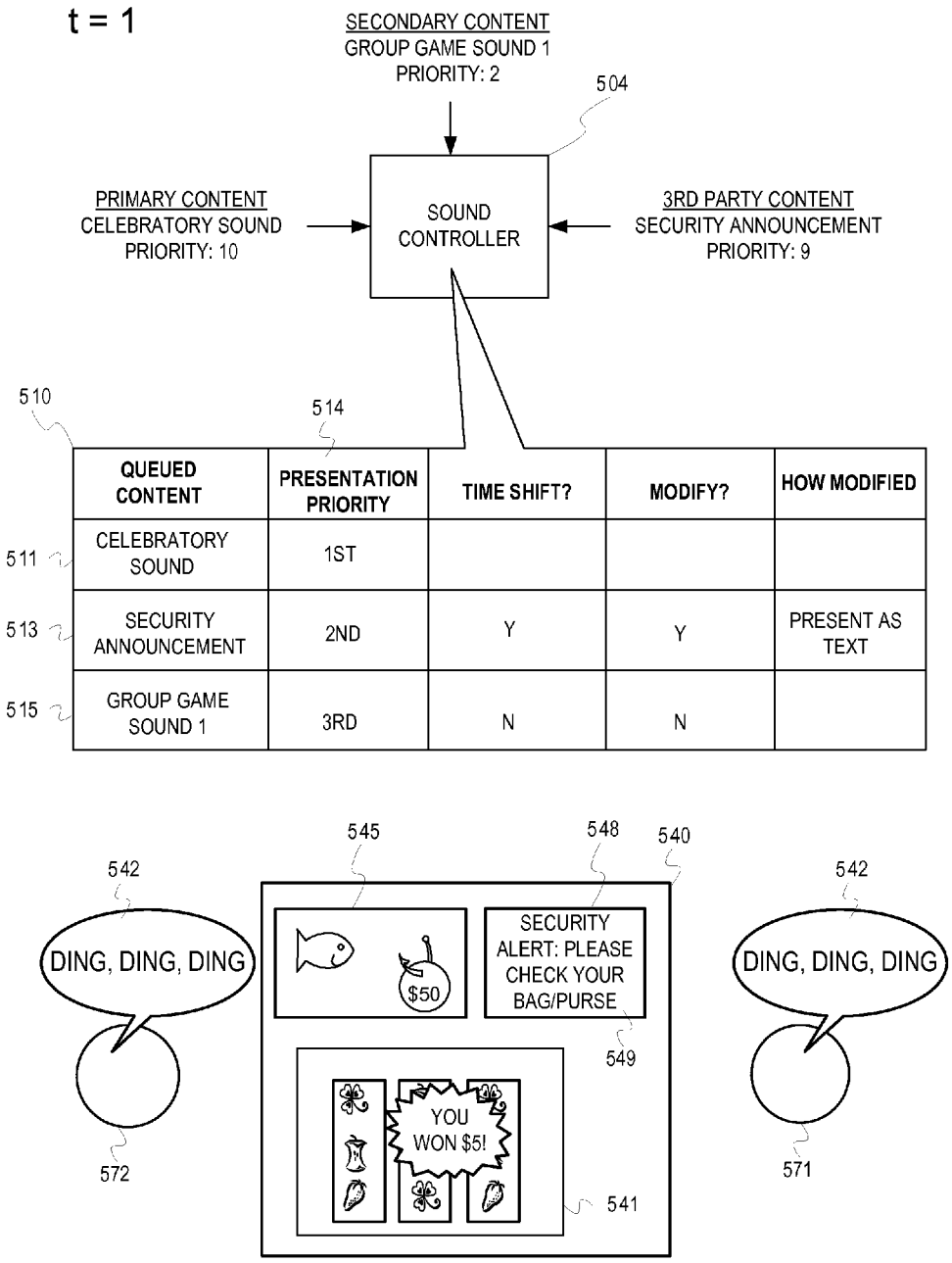
FIGS. 5-6 are illustrations of prioritizing and modifying presentation of configured gaming audio and non-configured audio feed(s), according to some embodiments.
Figure 6:
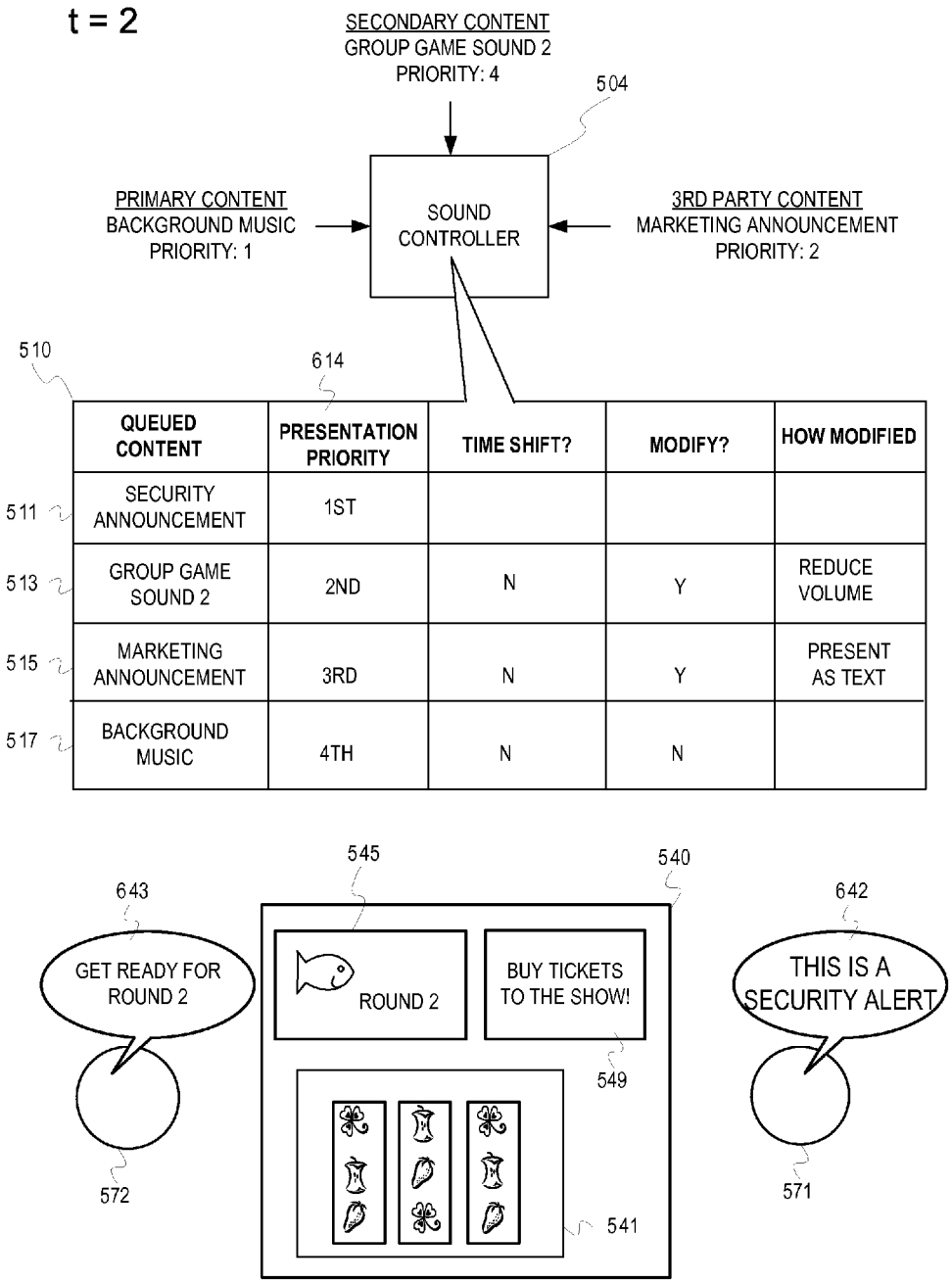

FIGS. 5-6 are illustrations of prioritizing and modifying presentation of configured gaming audio and non-configured audio feed(s), according to some embodiments. In FIG. 5, at a first time (i.e., t=1), a sound controller 504 receives primary wagering game sound content ("primary content"), secondary wagering game sound content ("secondary content"), and third party sound content ("third-party content"). The primary content is a celebratory sound for a winning game event that occurs in a primary wagering game 541 presented via a wagering game machine. The secondary content is a game sound for a group wagering game 545. The third-party content is a security announcement presented by a casino operator. The primary content, secondary content, and third party content each include metadata that describes a significance value, such as a priority value. For example, the primary content includes metadata that indicates a priority value of "10," the secondary content includes a priority value of "2,"

and the third-party content includes a priority value of "9." The sound controller 504 analyzes the various sound content, such as by analyzing audio characteristics. The sound controller 504 also evaluates the priority values against each other and generates a presentation priority 514. Based on the presentation priority 514, the sound controller 504 organizes the various sound content into a specific order within a queue 510. The content at the top position 511 of the queue 510 receives highest priority for presentation via speakers 572 and 571 of a wagering game machine. The sound controller 504 analyzes the content in the second position 513 of the queue 510 and the content in the third position 515 of the queue 510 to determine (1) if the content should receive modification to meet tolerances of a sound system for the wagering game machine, (2) if the content should be time shifted, or (3) if the content should be modified in some other way, such as to be converted to a different format, to modify a volume level, to change a location where the content should be presented, etc. such as described in FIG. 4 above. For example, the sound controller 504 determines that the security announcement should be in the second position 513 of the queue 510 and, because of the high priority value of "9," the sound controller 504 also determines that the third-party content should be recorded and presented via the speakers 571 and/or 572 at a later time after the celebratory sound completes presentation via the speakers 571 and 572. The sound controller 504 also determines, based on the priority value of the third-party content, that the security announcement should also be presented as text on a display 540 of the wagering game machine. The sound controller 505, therefore, can instruct the wagering game machine to present a celebratory sound effect 542 via the speakers 571 and 572 and present the security announcement as textual content 548 via a message console 549. The sound controller 504 further determines that the sound for the secondary content should be suppressed and not presented.

In FIG. 6, at a second time (t=2), after the celebratory sound completes presentation, the sound controller 504 receives, as the primary content, background music for the primary content 541 with a priority value of "1." The sound controller 504 also receives, as secondary content, a second group game sound with a priority value of "4." The sound controller 504 also receives, as third-party content, a marketing announcement with a priority value of "2." The sound controller 504 analyzes the various sound content, such as by analyzing audio characteristics. The sound controller 504 also evaluates the priority values against each other and generates a presentation priority 614. Based on the presentation priority 614, the sound controller 504 organizes the various sound content into a specific order within the queue 510. The content at the top position 511 of the queue 510 receives highest priority for presentation via speakers 572 and 571 of a wagering game machine. For example, the security announcement that was recorded and delayed until the second time (t=2), is at the top position 511 of the queue 510, and therefore, receives highest priority for presentation as a sound 642 via the speaker 571. The sound controller 504 analyzes the content in the second position 513 of the queue 510, the content in the third position 515 of the queue 510, and the content in a fourth position 517 of the queue 510 to again determine (1) if the content should receive modification to meet tolerances of a sound system for the wagering game machine, (2) if the content should be time shifted, or (3) if the content should be modified in some other way. For example, the sound controller 504 determines that the second group game sound should be in the second position 513 of the queue 510 and, because of the high priority value for the secondary content, the sound controller 504 determines that the secondary content should be presented concurrently with the audible presentation of the security announcement. For instance, the sound controller 504 presents a group game sound effect 643 from the speaker 572 concurrently with presentation of the sound 642 from the speaker 571. However, because the priority value for the security announcement was higher than the priority value of the second group game sound, then the sound controller determines to reduce the volume of the group game sound effect 643 when presented via the speaker 572. The sound controller 504 also determines that the third-party content is not significant enough to be time shifted, but should instead be converted to text and presented via the message console 549. The sound controller 504 further determines that the sound for the primary content, at the fourth position 517, should be suppressed and not presented.

Additional Example Embodiments

According to some embodiments, a wagering game sound control system ("system") can provide various example devices, operations, etc., to control wagering game system audio. The following paragraphs enumerate some possible embodiments.

In some embodiments, the system can relay two-way communications between a central location in a casino to a wagering game machine, such as an intercom system. In some embodiments, a wagering game machine can include a service call button that a casino patron can utilize at a wagering game machine to call to the central location or request a service via the two-way communication system.

In some embodiments, the system can incorporate announcements into content for a wagering game application. For example, in some embodiments, the announcements are related to a group accomplishment or related event that a casino operator may want to indicate while a group of players play a group wagering game. The system receives the announcement and causes a character in the group wagering game to appear to speak the words of the announcement (e.g., the game character moves its lips in a way that appears to speak the words of the announcement). In other instances, objects of the wagering game may respond dynamically to markers, embedded tones or other metadata presented in the announcement, or other sound content, included in an audio feed. For example, the metadata from the sound content of the audio feed indicates an announcement type (e.g., a theme of the announcement) and game objects presented on a display of the wagering game machine can modify appearance to match the theme.

Additional Example Operating Environments

This section describes example operating environments, systems and networks, and presents structural aspects of some embodiments.

Wagering Game Computer System

Figure 7:
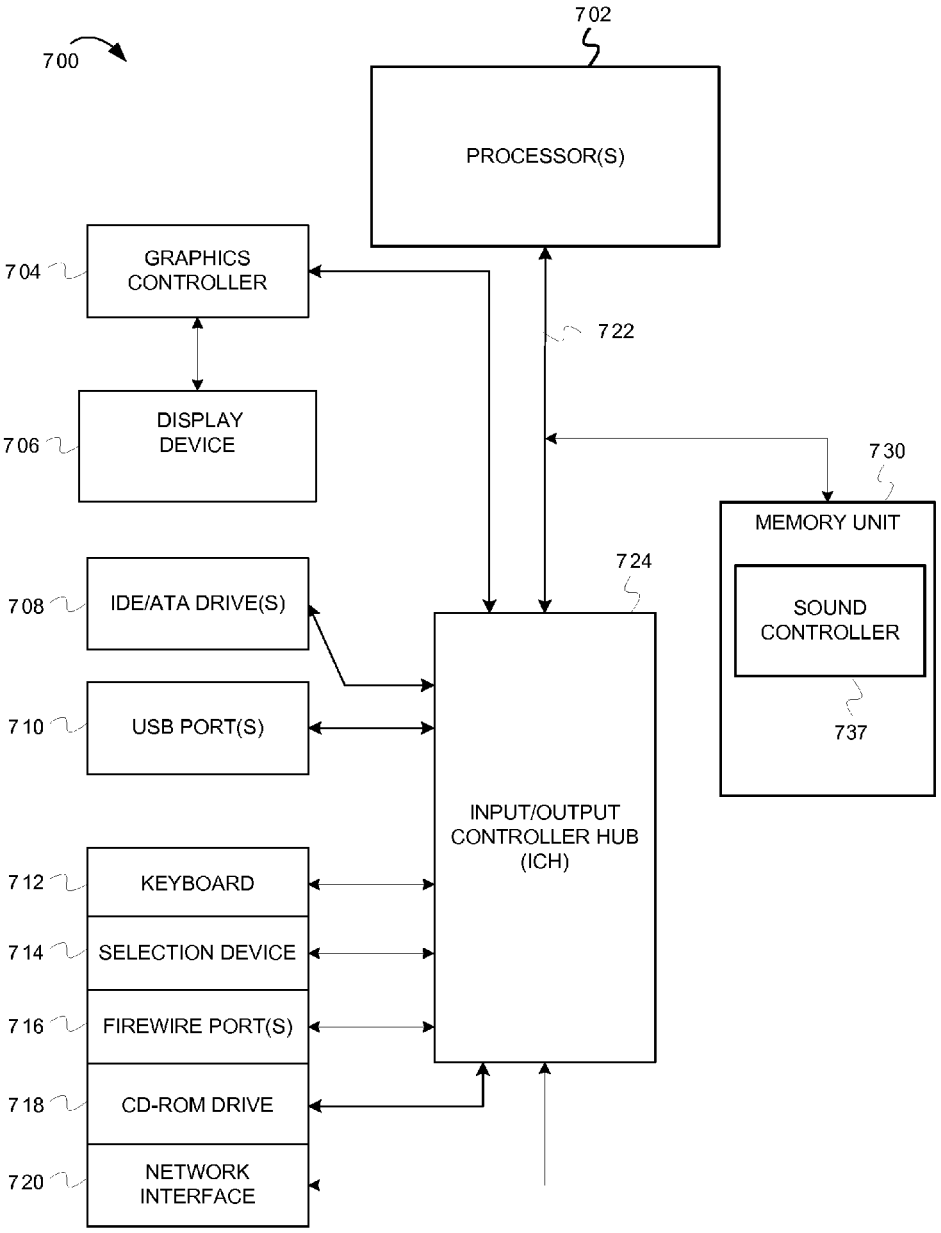
FIG. 7 is an illustration of a wagering game computer system 700, according to some embodiments.

FIG. 7 is a conceptual diagram that illustrates an example of a wagering game computer system 700, according to some embodiments. In FIG. 7, the computer system 700 may include a processor unit 702, a memory unit 730, a processor bus 722, and an Input/Output controller hub (ICH) 724. The processor unit 702, memory unit 730, and ICH 724 may be coupled to the processor bus 722. The processor unit 702 may comprise any suitable processor architecture. The computer system 700 may comprise one, two, three, or more processors, any of which may execute a set of instructions in accordance with some embodiments.

The memory unit 730 may also include an I/O scheduling policy unit 7 and I/O schedulers 7. The memory unit 730 can store data and/or instructions, and may comprise any suitable memory, such as a dynamic random access memory (DRAM), for example. The computer system 700 may also include one or more suitable integrated drive electronics (IDE) drive(s) 708 and/or other suitable storage devices. A graphics controller 704 controls the display of information on a display device 706, according to some embodiments.

The input/output controller hub (ICH) 724 provides an interface to I/O devices or peripheral components for the computer system 700. The ICH 724 may comprise any suitable interface controller to provide for any suitable communication link to the processor unit 702, memory unit 730 and/or to any suitable device or component in communication with the ICH 724. The ICH 724 can provide suitable arbitration and buffering for each interface.

For one embodiment, the ICH 724 provides an interface to the one or more IDE drives 708, such as a hard disk drive (HDD) or compact disc read only memory (CD ROM) drive, or to suitable universal serial bus (USB) devices through one or more USB ports 710. For one embodiment, the ICH 724 also provides an interface to a keyboard 712, selection device 714 (e.g., a mouse, trackball, touchpad, etc.), CD-ROM drive 718, and one or more suitable devices through one or more firewire ports 716. For one embodiment, the ICH 724 also provides a network interface 720 through which the computer system 700 can communicate with other computers and/or devices.

The computer system 700 may also include a machine-readable storage medium that stores a set of instructions (e.g., software) embodying any one, or all, of the methodologies for control of wagering game system audio. Furthermore, software can reside, completely or at least partially, within the memory unit 730 and/or within the processor unit 702. The computer system 700 can also include a sound controller 737. The sound controller 737 can process communications, commands, or other information, to control wagering game system audio. Any component of the computer system 700 can be implemented as hardware, firmware, and/or machine-readable storage media including instructions for performing the operations described herein.

Wagering Game Machine Architecture

Figure 8:
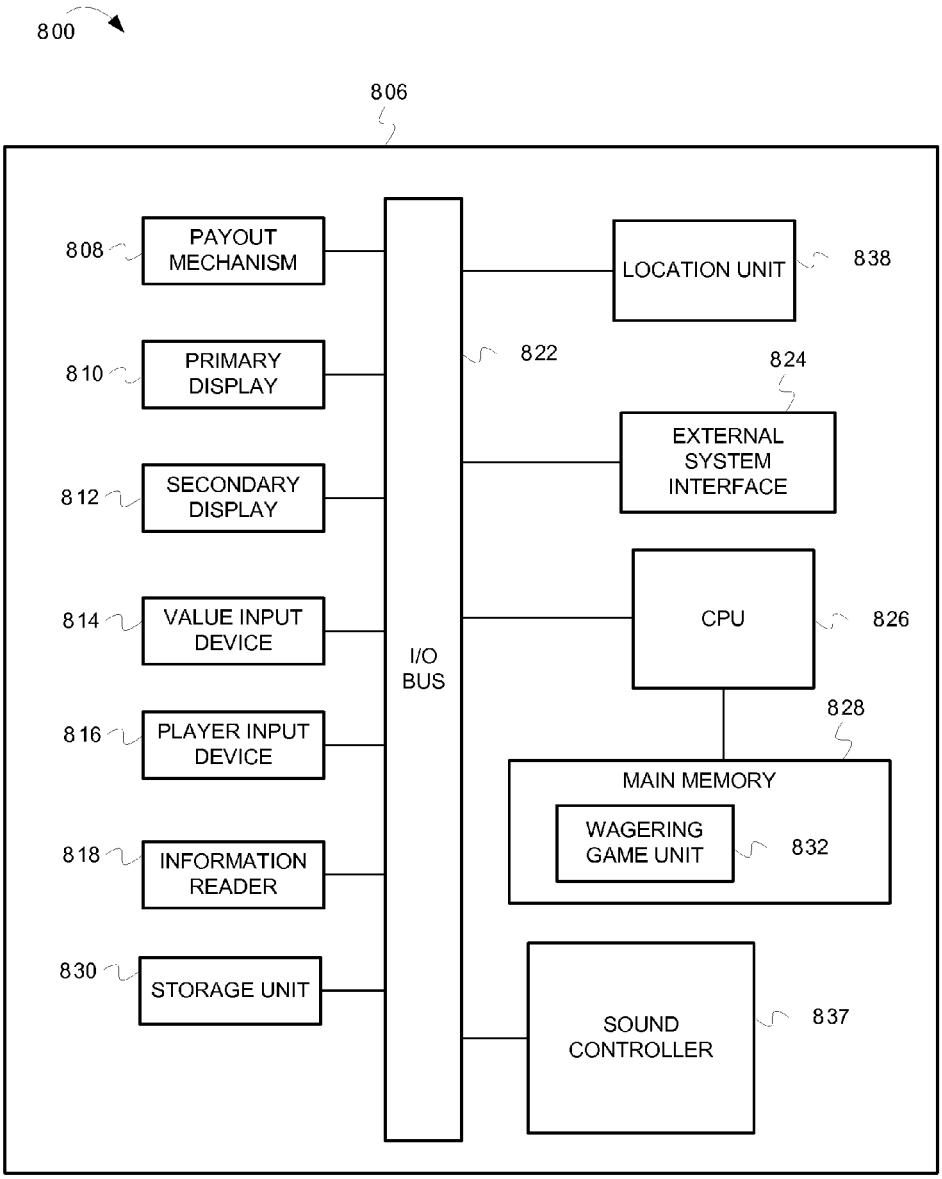
FIG. 8 is an illustration of a wagering game machine architecture 800, according to some embodiments.

FIG. 8 is a conceptual diagram that illustrates an example of a wagering game machine architecture 800, according to some embodiments. In FIG. 8, the wagering game machine architecture 800 includes a wagering game machine 806, which includes a central processing unit (CPU) 826 connected to main memory 828. The CPU 826 can include any suitable processor, such as an Intel® Pentium processor, Intel® Core 2 Duo processor, AMD Opteron™ processor, or UltraSPARC processor. The main memory 828 includes a wagering game unit 832. In some embodiments, the wagering game unit 832 can present wagering games, such as video poker, video black jack, video slots, video lottery, reel slots, etc., in whole or part.

The CPU 826 is also connected to an input/output ("I/O") bus 822, which can include any suitable bus technologies, such as an AGTL+frontside bus and a PCI backside bus. The I/O bus 822 is connected to a payout mechanism 808, primary display 810, secondary display 812, value input device 814, player input device 816, information reader 818, and storage unit 830. The player input device 816 can include the value input device 814 to the extent the player input device 816 is used to place wagers. The I/O bus 822 is also connected to an external system interface 824, which is connected to external systems (e.g., wagering game networks). The external system interface 824 can include logic for exchanging information over wired and wireless networks (e.g., 802.11g transceiver, Bluetooth transceiver, Ethernet transceiver, etc.)

The I/O bus 822 is also connected to a location unit 838. The location unit 838 can create player information that indicates the wagering game machine's location/movements in a casino. In some embodiments, the location unit 838 includes a global positioning system (GPS) receiver that can determine the wagering game machine's location using GPS satellites. In other embodiments, the location unit 838 can include a radio frequency identification (RFID) tag that can determine the wagering game machine's location using RFID readers positioned throughout a casino. Some embodiments can use GPS receiver and RFID tags in combination, while other embodiments can use other suitable methods for determining the wagering game machine's location. Although not shown in FIG. 8, in some embodiments, the location unit 838 is not connected to the I/O bus 822.

In some embodiments, the wagering game machine 806 can include additional peripheral devices and/or more than one of each component shown in FIG. 8. For example, in some embodiments, the wagering game machine 806 can include multiple external system interfaces 824 and/or multiple CPUs 826. In some embodiments, any of the components can be integrated or subdivided.

In some embodiments, the wagering game machine 806 includes a sound controller 837. The sound controller 837 can process communications, commands, or other information, where the processing can control wagering game system audio.

Furthermore, any component of the wagering game machine 806 can include hardware, firmware, and/or machine-readable storage media including instructions for performing the operations described herein.

Wagering Game Machine

Figure 9:
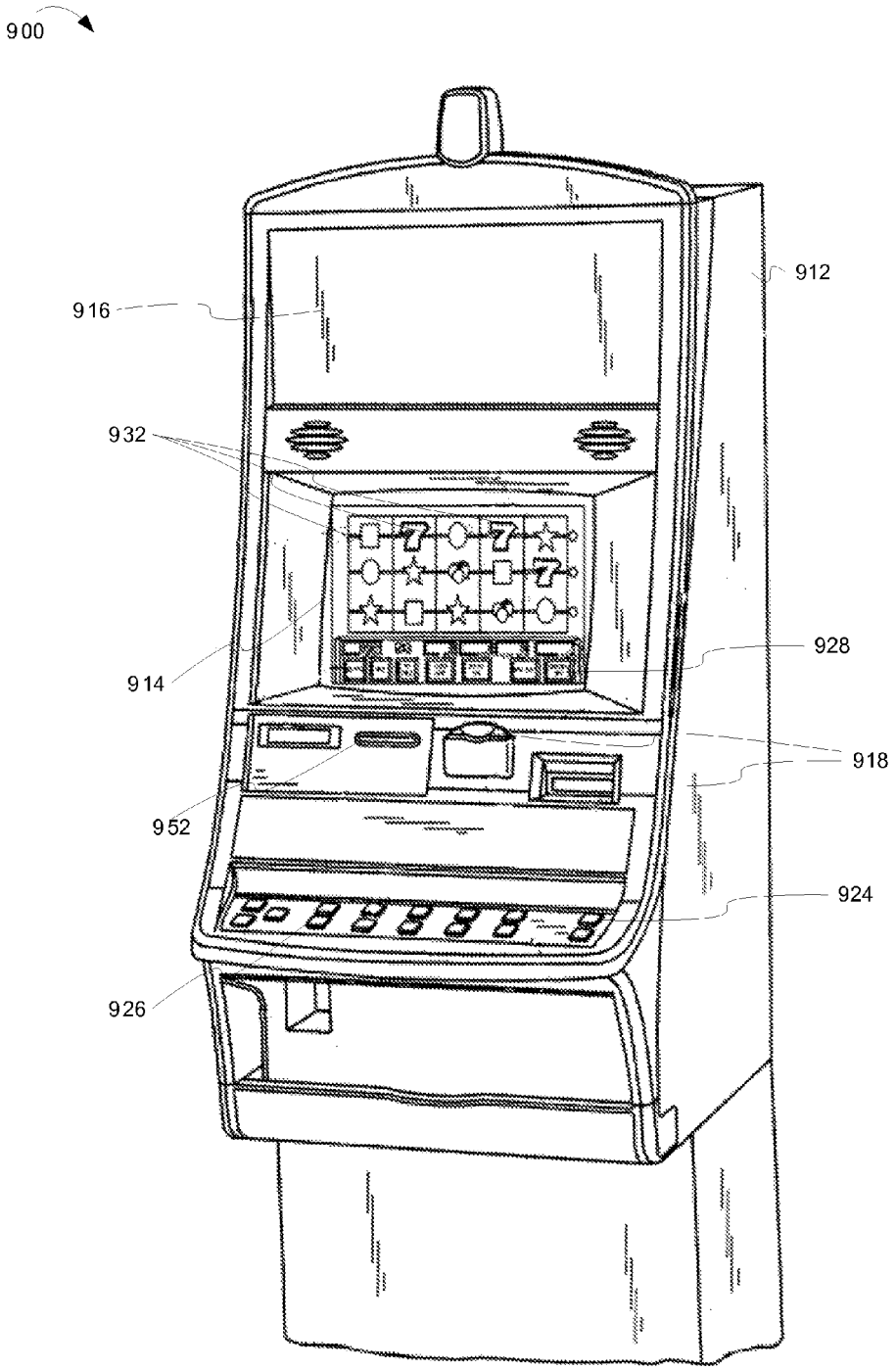
FIG. 9 is an illustration of a wagering game machine 900, according to some embodiments.

FIG. 9 is a conceptual diagram that illustrates an example of a wagering game machine 900, according to some embodiments. Referring to FIG. 9, the wagering game machine 900 can be used in gaming establishments, such as casinos. According to some embodiments, the wagering game machine 900 can be any type of wagering game machine and can have varying structures and methods of operation. For example, the wagering game machine 900 can be an electromechanical wagering game machine configured to play mechanical slots, or it can be an electronic wagering game machine configured to play video casino games, such as blackjack, slots, keno, poker, blackjack, roulette, etc.

The wagering game machine 900 comprises a housing 912 and includes input devices, including value input devices 918 and a player input device 924. For output, the wagering game machine 900 includes a primary display 914 for displaying information about a basic wagering game. The primary display 914 can also display information about a bonus wagering game and a progressive wagering game. The wagering game machine 900 also includes a secondary display 916 for displaying wagering game events, wagering game outcomes, and/or signage information. While some components of the wagering game machine 900 are described herein, numerous other elements can exist and can be used in any number or combination to create varying forms of the wagering game machine 900.

The value input devices 918 can take any suitable form and can be located on the front of the housing 912. The value input devices 918 can receive currency and/or credits inserted by a player. The value input devices 918 can include coin acceptors for receiving coin currency and bill acceptors for receiving paper currency. Furthermore, the value input devices 918 can include ticket readers or barcode scanners for reading information stored on vouchers, cards, or other tangible portable storage devices. The vouchers or cards can authorize access to central accounts, which can transfer money to the wagering game machine 900.

The player input device 924 comprises a plurality of push buttons on a button panel 926 for operating the wagering game machine 900. In addition, or alternatively, the player input device 924 can comprise a touch screen 928 mounted over the primary display 914 and/or secondary display 916.

The various components of the wagering game machine 900 can be connected directly to, or contained within, the housing 912. Alternatively, some of the wagering game machine's components can be located outside of the housing 912, while being communicatively coupled with the wagering game machine 900 using any suitable wired or wireless communication technology.

The operation of the basic wagering game can be displayed to the player on the primary display 914. The primary display 914 can also display a bonus game associated with the basic wagering game. The primary display 914 can include a cathode ray tube (CRT), a high resolution liquid crystal display (LCD), a plasma display, light emitting diodes (LEDs), or any other type of display suitable for use in the wagering game machine 900. Alternatively, the primary display 914 can include a number of mechanical reels to display the outcome. In FIG. 9, the wagering game machine 900 is an "upright" version in which the primary display 914 is oriented vertically relative to the player. Alternatively, the wagering game machine can be a "slant-top" version in which the primary display 914 is slanted at about a thirty-degree angle toward the player of the wagering game machine 900. In yet another embodiment, the wagering game machine 900 can exhibit any suitable form factor, such as a free standing model, bar top model, mobile handheld model, or workstation console model.

A player begins playing a basic wagering game by making a wager via the value input device 918. The player can initiate play by using the player input device's buttons or touch screen 928. The basic game can include arranging a plurality of symbols along a pay line 932, which indicates one or more outcomes of the basic game. Such outcomes can be randomly selected in response to player input. At least one of the outcomes, which can include any variation or combination of symbols, can trigger a bonus game.

In some embodiments, the wagering game machine 900 can also include an information reader 952, which can include a card reader, ticket reader, bar code scanner, RFID transceiver, or computer readable storage medium interface. In some embodiments, the information reader 952 can be used to award complimentary services, restore game assets, track player habits, etc.

Embodiments may take the form of an entirely hardware embodiment, an entirely software embodiment (including firmware, resident software, micro-code, etc.) or an embodiment combining software and hardware aspects that may all generally be referred to herein as a "circuit," "module" or "system." Furthermore, embodiments of the inventive subject matter may take the form of a computer program product embodied in any tangible medium of expression having computer readable program code embodied in the medium. The described embodiments may be provided as a computer program product that may include a machine-readable storage medium having stored thereon instructions, which may be used to program a computer system to perform a process according to embodiments(s), whether presently described or not, because every conceivable variation is not enumerated herein. A machine-readable storage medium includes any mechanism that stores information in a form readable by a machine (e.g., a wagering game machine, computer, etc.). For example, machine-readable storage media includes read only memory (ROM), random access memory (RAM), magnetic disk storage media, optical storage media (e.g., CD-ROM), flash memory machines, erasable programmable memory (e.g., EPROM and EEPROM); etc. Some embodiments of the invention can also include machine-readable signal media, such as any media suitable for transmitting software over a network.

General

This detailed description refers to specific examples in the drawings and illustrations. These examples are described in sufficient detail to enable those skilled in the art to practice the inventive subject matter. These examples also serve to illustrate how the inventive subject matter can be applied to various purposes or embodiments. Other embodiments are included within the inventive subject matter, as logical, mechanical, electrical, and other changes can be made to the example embodiments described herein. Features of various embodiments described herein, however essential to the example embodiments in which they are incorporated, do not limit the inventive subject matter as a whole, and any reference to the invention, its elements, operation, and application are not limiting as a whole, but serve only to define these example embodiments. This detailed description does not, therefore, limit embodiments, which are defined only by the appended claims. Each of the embodiments described herein are contemplated as falling within the inventive subject matter, which is set forth in the following claims.

The invention claimed is:

1. A method of operating a wagering game system, the wagering game system including one or more sound controllers dedicated to controlling presentation of sounds associated with a casino wagering game via a sound presentation device associated with the wagering game system, said method comprising:

receiving sound content for presentation via the sound presentation device associated with the wagering game system;

evaluating, by at least one of the one or more sound controllers, an audio characteristic of the sound content against a sound presentation tolerance of the sound presentation device;

based on the evaluating of the audio characteristic, determining, by at least one of the one or more sound controllers, that at least a portion of the sound content is presentable via the sound presentation device without exceeding the sound presentation tolerance; and providing the at least a portion of the sound content for presentation via the sound presentation device.

2. The method of claim 1, wherein the sound content is received from a source that is external to the wagering game system, and wherein, prior to being received the sound content is not configured for presentation via the sound presentation device according to the sound presentation tolerance.

3. The method of claim 1, wherein the audio characteristic comprises one of more of a frequency value, a volume level, a power level, and a duration.

4. The method of claim 1 further comprising:

determining, based on the evaluating of the audio characteristic, that presentation of an additional portion of the sound content would exceed the sound presentation tolerance of the sound presentation device;

modifying a portion of the audio characteristic associated with the additional portion of the sound content to be within the sound presentation tolerance of the sound presentation device; and after the modifying of the portion of the audio characteristic associated with the additional portion of the sound content, providing the additional portion of the sound content for concurrent presentation with the at least a portion of the sound content via the sound presentation device.

5. The method of claim 1 further comprising:

prior to the providing the at least a portion of the sound content for presentation via the sound presentation device, determining that presentation of the at least a portion of the sound content would overlap in presentation with a scheduled presentation of additional sound content, wherein the additional sound content is associated with a wagering game event of a wagering game application presented via the casino wagering game; and computing a priority of presentation for the sound content in relation to the additional sound content based on a significance of the wagering game event.

6. The method of claim 5 further comprising causing suppression of presentation of either the at least a portion of the sound content or the additional sound content based on the priority of presentation.

7. The method of claim 5 further comprising one or more of modifying volume levels of the at least a portion of the sound content and the additional sound content in proportion to the priority of presentation and selecting a location for presentation of the one or more of the sound content and the additional sound content based on the priority of presentation.

8. The method of claim 5, wherein the computing the priority of presentation for the sound content and the additional sound content comprises:

evaluating a first significance value of the sound content against a second significance value of the additional sound content; and determining, based on evaluation of the first significance value against the second significance value, the priority of presentation.

9. The method of claim 8, wherein the one or more of the sound content and the additional sound content comprise metadata that indicates one or more of the first significance value, the second significance value, a type of sound, a type of event, an origin of a sound file, a win amount, a description of a gaming accomplishment associated with a sound, a frequency value, a power level, a duration, a file marker, a leader tone, a trailer tone, and a file name.

10. The method of claim 5 further comprising prior to the providing the at least a portion of the sound content for presentation via the sound presentation device, determining, based on the priority of presentation, that the additional sound content should be presented prior to presentation of the at least a portion of the sound content;

storing the at least a portion of the sound content in a buffer in response to determining that the additional sound content should be presented prior to presentation of the at least a portion of the sound content; and providing the at least a portion of the sound content for presentation, from the buffer, after the additional sound content has been presented.

11. One or more non-transitory, machine-readable storage media having instructions stored thereon, which when executed by a set of one or more sound controllers of a wagering game system cause the set of one or more sound controllers to perform operations comprising:

receiving sound content for presentation via a sound presentation device associated with the wagering game system, wherein the sound content is received from a source that is external to the wagering game system, wherein the sound content is not configured for presentation according to a sound presentation tolerance of the sound presentation device, and wherein the set of one or more sound controllers are dedicated to controlling presentation of sounds associated with one or more casino wagering games;

evaluating an audio characteristic of the sound content against the sound presentation tolerance;

determining, based on evaluation of the audio characteristic, that presentation of at least a portion of the sound content would exceed the sound presentation tolerance;

modifying the audio characteristic of the sound content to meet the sound presentation tolerance; and after modifying the audio characteristic of the sound content, providing the at least a portion of the sound content for presentation via the sound presentation device.

12. The one or more non-transitory, machine-readable storage media of claim 11, wherein the operation for modifying the audio characteristic of the sound content to meet the sound presentation tolerance of the sound presentation device includes an operation comprising removing at least one frequency of the sound content, wherein the at least one frequency is within a frequency range that, when played, would exceed a power usage limit of the sound presentation device.

13. The one or more non-transitory, machine-readable storage media of claim 11, wherein the operation for modifying the audio characteristic of the sound content to meet the sound presentation tolerance of the sound presentation device comprises reducing one or more of a volume level, a power level, and a duration of the sound content.

14. The one or more non-transitory, machine-readable storage media of claim 11, said operations further comprising:

prior to the providing the at least a portion of the sound content for presentation via the sound presentation device, determining that presentation of the at least a portion of the sound content would overlap in presentation with a scheduled presentation of additional sound content configured for presentation via the sound presentation device, wherein the additional sound content is associated with a wagering game event of a wagering game application presented via the wagering game system; and computing a priority of presentation for the sound content in relation to the additional sound content based on a significance of the wagering game event.

15. The one or more non-transitory, machine-readable storage media of claim 14, said operations further comprising;

prior to the providing the at least a portion of the sound content for presentation via the sound presentation device, determining, based on the priority of presentation, that the additional sound content should be presented prior to presentation of the at least a portion of the sound content;

storing the at least a portion of the sound content in a buffer in response to determining that the additional sound content should be presented prior to presentation of the at least a portion of the sound content; and providing the at least a portion of the sound content for presentation, from the buffer, after the additional sound content has been presented.

16. The one or more non-transitory, machine-readable storage media of claim 11, wherein the operations further comprise:

determining that an additional sound content is scheduled to be presented via the sound presentation device concurrently with a presentation of the at least a portion of the sound content;

determining that concurrent presentation of the at least a portion of the sound content and the additional sound content would exceed the sound presentation tolerance; and normalizing the concurrent presentation of the sound content and the additional sound content to meet the sound presentation tolerance.

17. A wagering game system comprising:

one or more sound controllers dedicated to controlling presentation of sounds associated with one or more casino wagering games; and a memory unit configured to store instructions which, when executed by at least one of the one or more sound controllers, cause the wagering game system to receive the sound content from a source external to the wagering game system, evaluate an audio characteristic of the sound content against a sound presentation tolerance of a sound presentation device of the wagering game system, determine, based on evaluation of the audio characteristic, that at least a portion of the sound content is presentable via the sound presentation device without exceeding the sound presentation tolerance of the sound presentation device, determine that presentation of the at least a portion of the sound content would overlap with a presentation of additional sound content scheduled for presentation via the sound presentation device, and determine a priority of presentation of the at least a portion of the sound content in relation to the additional sound content.

18. The wagering game system of claim 17, wherein the instruction to determine the priority of presentation includes instructions which, when executed by the at least one of the one or more sound controllers, cause the wagering game system to evaluate a significance of a wagering game event against a significance of the at least a portion of the sound content, wherein the wagering game event is associated with the additional sound content, and wherein the wagering game event is generated via a wagering game application presented via the wagering game system; and compute the priority of presentation based on evaluation of the significance of the wagering game event against the significance of the at least a portion of the sound content.

19. The wagering game system of claim 17, wherein the sound content is not optimized for presentation via the sound presentation device, wherein the additional sound content is wagering game sound content from a wagering game application, said additional sound content being configured for presentation via the sound presentation device.

20. A wagering game apparatus comprising:

one or more processors; and a sound controller dedicated to controlling presentation of sounds associated with one or more casino wagering games, said sound controller configured, via use of at least one of the one or more processors, to receive sound content via an audio feed from a source external to the wagering game apparatus, wherein the sound content is not configured for presentation via a sound presentation device associated with the wagering game apparatus, evaluate an audio characteristic of the sound content against a sound presentation tolerance of the sound presentation device, determine, based on evaluation of the audio characteristic against the sound presentation tolerance, that presentation of the sound content according to the audio characteristic would exceed the sound presentation tolerance, modify the audio characteristic of the sound content to be within the sound presentation tolerance, and present the sound content via the sound presentation device, subsequent to modification of the audio characteristic of the sound content.

21. The wagering game apparatus of claim 20 wherein the sound controller, configured to modify the audio characteristic, is further configured to one or more of filter a frequency of the sound content, reduce a power level of the sound content, reduce a volume level of the sound content, and decrease a duration or presentation of the sound content.

22. The wagering game apparatus of claim 20, wherein the sound controller is further configured to embed tones in the sound content, wherein the tones cause the at least a portion of the audio characteristic to be within the sound presentation tolerance.

23. The wagering game apparatus of claim 22, wherein the tones indicate one or more of a beginning of the sound content, an end of the sound content, an identifier for the wagering game apparatus, an identifier for a group of wagering game machines, an identifier for a specific section of a casino, a type of the sound content, a volume level of the sound content, a duration of the sound content, and a power level of the sound content.

24. The wagering game apparatus of claim 20 wherein the sound controller is further configured to prior to presentation of the sound content, determine that presentation of the sound content would overlap in presentation with a scheduled presentation of additional sound content, wherein the additional sound content is associated with a wagering game event of a wagering game application presented via the wagering game apparatus;

compute a priority of presentation for the sound content based on evaluation of a significance of the wagering game event against a significance of the sound content; and present the sound content according to the priority of presentation.

25. A wagering game apparatus dedicated to controlling presentation of sounds associated with one or more casino wagering games, said wagering game apparatus comprising:

means for receiving sound content, from a source external to the wagering game apparatus, to present via a sound presentation device associated with the wagering game apparatus;

means for determining, based on evaluation of a first audio characteristic of a first portion of the sound content against a sound presentation tolerance of the sound presentation device, that presentation of the first portion of the sound content would exceed the sound presentation tolerance of the sound presentation device;

means for determining, based on evaluation of a second audio characteristic of a second portion of the sound content against the sound presentation tolerance, that presentation of the second portion of the sound content would not exceed the sound presentation tolerance;

means for suppressing presentation of the first portion of the sound content in response to the determining that the presentation of the first portion of the sound content would exceed the sound presentation tolerance of the sound presentation device; and means for presenting the second portion of the sound content in response to the determining that the presentation of the second portion of the sound content would not exceed the sound presentation tolerance.

26. The wagering game apparatus of claim 25 wherein the means for suppressing the first portion of the sound content comprises means for filtering frequencies of the sound content below approximately 200 hertz.

27. The wagering game apparatus of claim 25 wherein the sound content is for non-wagering game content that is not configured for presentation via the sound presentation device.

28. The wagering game apparatus of claim 25 further comprising:

means for determining that presentation of the second portion of the sound content conflicts with a scheduled presentation of additional sound content from a wagering game, wherein the additional sound content is associated with an event for the wagering game;

means for evaluating a significance of the sound content to a significance of the event; and means for prioritizing presentation of the sound content and the additional sound content based on the evaluating.

* * * * *